US012396555B2

(12) United States Patent
Ng

(10) Patent No.: US 12,396,555 B2
(45) Date of Patent: Aug. 26, 2025

(54) VANITY FOLD-OUT ORGANIZER

(71) Applicant: Ikou Inc., Markham (CA)

(72) Inventor: Sherky Ng, Toronto (CA)

(73) Assignee: IKOU INC., Markham (CA)

( * ) Notice: Subject to any disclaimer, the term of this patent is extended or adjusted under 35 U.S.C. 154(b) by 65 days.

(21) Appl. No.: 18/257,990

(22) PCT Filed: Dec. 24, 2020

(86) PCT No.: PCT/CA2020/051798
§ 371 (c)(1),
(2) Date: Jun. 16, 2023

(87) PCT Pub. No.: WO2022/133571
PCT Pub. Date: Jun. 30, 2022

(65) Prior Publication Data

US 2024/0049879 A1 Feb. 15, 2024

(51) Int. Cl.
*A47B 88/994* (2017.01)
*A47B 88/90* (2017.01)

(52) U.S. Cl.
CPC ..... *A47B 88/994* (2017.01); *A47B 2088/901* (2017.01)

(58) Field of Classification Search
CPC ..... A47B 88/994; A47B 2088/901
USPC ..... 312/334.2, 334.3, 302, 902
See application file for complete search history.

(56) References Cited

U.S. PATENT DOCUMENTS 1,675,484 A * 7/1928 Coe ..... B25H 3/023 312/902
1,893,527 A 1/1933 Shriver
2,036,518 A * 4/1936 Czischki ..... A47B 67/02 190/30
2,710,093 A 6/1955 Raker
4,621,308 A * 11/1986 Holmberg ..... B25H 3/023 362/310
4,739,577 A * 4/1988 Lanius ..... B25H 3/023 43/57.1
7,168,773 B1 1/2007 Emary
(Continued)

OTHER PUBLICATIONS

International Preliminary Report on Patentability (Chapter II) dated Mar. 23, 2023.
International Search Report dated Aug. 30, 2021.

*Primary Examiner* — James O Hansen
(74) *Attorney, Agent, or Firm* — Dickinson Wright LLP; Yuri Chumak

(57) ABSTRACT

A vanity fold-out organizer includes an organizer body and a first tray including a storage compartment positioned above the organizer body. A second tray is positioned above the first tray. A plurality of links couples the trays to the organizer body and/or lower trays to allow pivotable movement relative to the base between a tray open position and a tray closed position. The organizer body is disposed for sliding movement from a retracted position to an extended position relative to the vanity. The tray open position is available when the organizer body is in the extended position. The organizer body is disposed partly beneath a plumbing assembly including a plumbing trap and the first and second trays are sized to fit beside the plumbing assembly in the tray closed position when the organizer body is in the retracted position.

7 Claims, 17 Drawing Sheets

(56) References Cited

U.S. PATENT DOCUMENTS

| | | | |
|---|---|---|---|
| 2005/0099101 | A1 | 5/2005 | Lowe |
| 2007/0159040 | A1 | 7/2007 | Fernandez et al. |

* cited by examiner

VANITY FOLD-OUT ORGANIZER

FIELD OF THE INVENTION

The field of the invention is household furniture including dressing tables and vanities and, in particular, a vanity fold-out organizer.

BACKGROUND

The following description includes information that may be useful in understanding the present invention. It is not an admission that any of the information provided herein is prior art or relevant to the presently claimed invention, or that any publication specifically or implicitly referenced is prior art.

There has been a significant expansion in the use of cosmetics, grooming products, jewelry, and accessories particularly among the millennial generation. The proliferation of products has created a need for storage of these items in household bathrooms in an organized fashion. Bathrooms tend to be smaller spaces and therefore it is a challenging problem to maintain tidiness in these spaces while keeping items within reach.

Expandable drawer inserts and organizers with folding or hinged trays are generally known. US Patent Publication No. US20070159040 is directed to an expandable drawer insert and an organizer with a hinged tray. The examples disclosed in this document are well suited to kitchen settings (e.g., for storing metal knives or different sizes of flatware), but are not designed around obstructions in furniture interiors, as is common with bathroom vanities, and are not positioned for ergonomic and accessible access to bathroom items.

Thus, there is still a need for a vanity fold-out organizer that allows for convenient, accessible, expandable storage for cosmetics, grooming products, jewelry, and related items.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of features used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

BRIEF DESCRIPTION OF THE DRAWINGS

Various objects, features, aspects, and advantages of the inventive subject matter will become more apparent from the following detailed description of preferred embodiments, along with the accompanying drawing figures in which like numerals represent like components.

DETAILED DESCRIPTION

Figure 1:
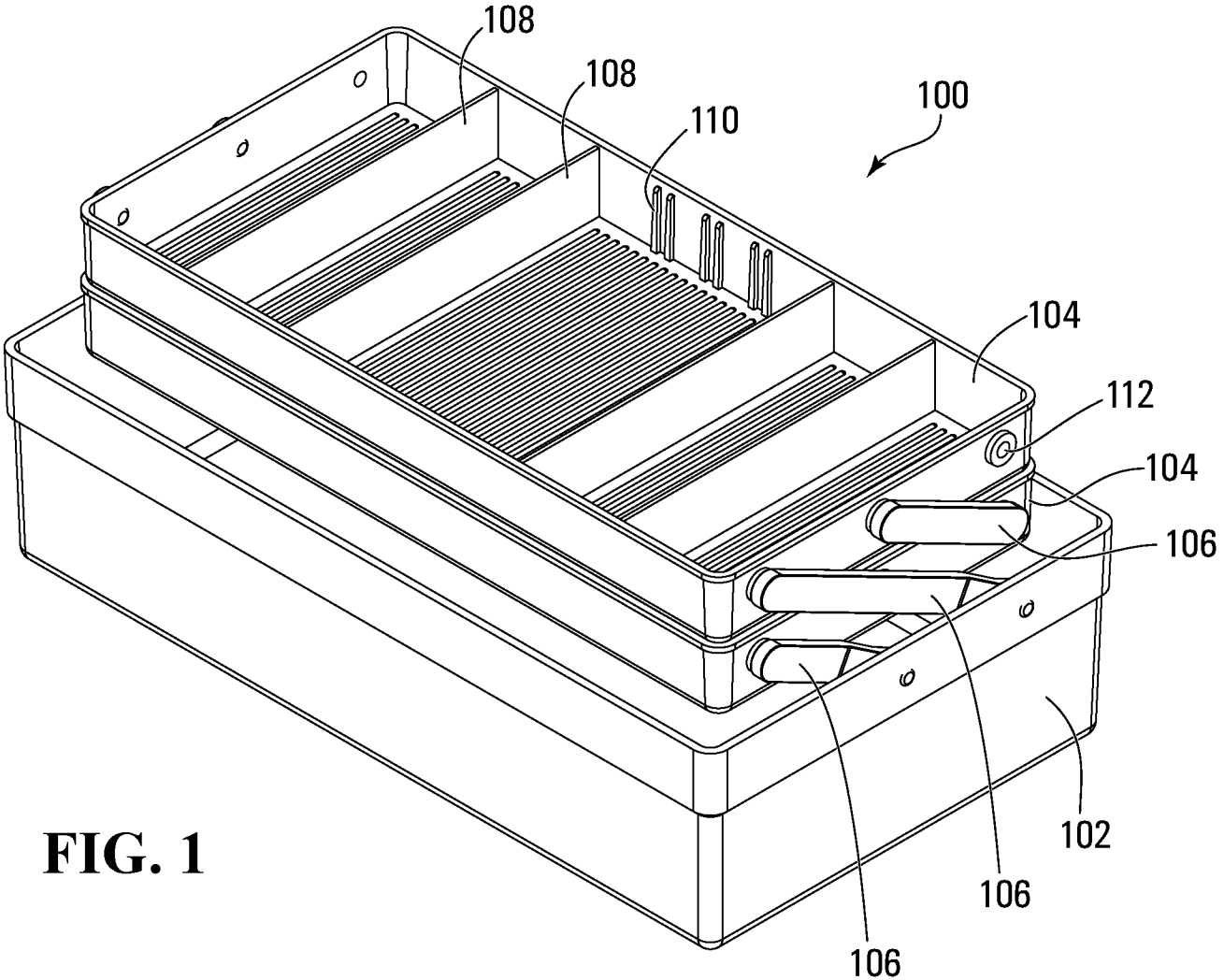
FIG. 1 is a perspective view of a vanity fold-out organizer in accordance with an example of the present specification, in a closed position.

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", "third" and other such numerical terms referring to structures do not imply a sequence or order unless clearly indicated by the context.

A vanity is an item of bathroom furniture, fitted with a sink or washbasin along with a mirror and drawers for storage, typically used for storing makeup, lotions, jewelry, and other cosmetic products. According to aspects of the present specification, there are provided various examples of organizers for use with vanities. The term organizer generally refers to rectangular or other shaped compartments for storage of small items. According to some examples, the organizers can be installed in one or more drawers of a vanity or other items of furniture. The organizers can be made integral with the vanity or other furniture using drawers/sliding shelves, or can be provided as a detachable or an after-market product for installation in drawers, shelves, or vanities. Various sizes of organizers are contemplated according to the present specification.

One example of a vanity fold-out organizer includes an organizer body and a first tray including a storage compartment positioned above the organizer body. A second tray is positioned above the first tray. A plurality of links couples the trays to the organizer body and/or lower trays to allow pivotable movement relative to the base between a tray open position and a tray closed position. The organizer body is disposed for sliding movement from a retracted position to an extended position relative to the vanity. The tray open position is available when the organizer body is in the extended position. The organizer body is configured to be disposed in a lower portion of the vanity partly beneath a plumbing assembly including a plumbing trap and the first and second trays are sized to fit beside the plumbing assembly in the tray closed position when the organizer body is in the retracted position.

Advantageously, convenient organization of items stored can be achieved by employing the devices according to the present specification, making it easier for users to view, locate and retrieve items, and to enable a greater number of items to be stored.

Moreover, when installed in the lower portion of a vanity or other piece of furniture, the devices of the present specification permit ergonomic and/or accessible and/or barrier-free access to an increased number of items. The term "barrier-free" refers to a design for those with physical or other disabilities, involving the provision of alternative means of access for those with mobility restrictions.

FIG. 1 illustrates a vanity fold-out organizer in accordance with an example of the present specification. As shown in FIG. 1, the vanity fold-out organizer 100 includes a body 102. The body 102 generally includes a bottom portion, outer walls or side portions, and interior walls extending upwardly from the bottom portion of the body 102. The bottom portion of the body 102 may be flat or ribbed for strength and durability. In the example of FIG. 1, the outer sidewalls and interior walls cooperate to define a generally rectangular compartment. This compartment may be used to store a wide range of items. In some examples, one or more compartments can be shaped, sized, or otherwise designed for holding a particular type of item. Alternative examples can include a body 102 having more or fewer walls and/or having walls in different configurations (e.g., differently sized, spaced, oriented, arranged, etc.) than what is shown in the drawings.

Figure 2:
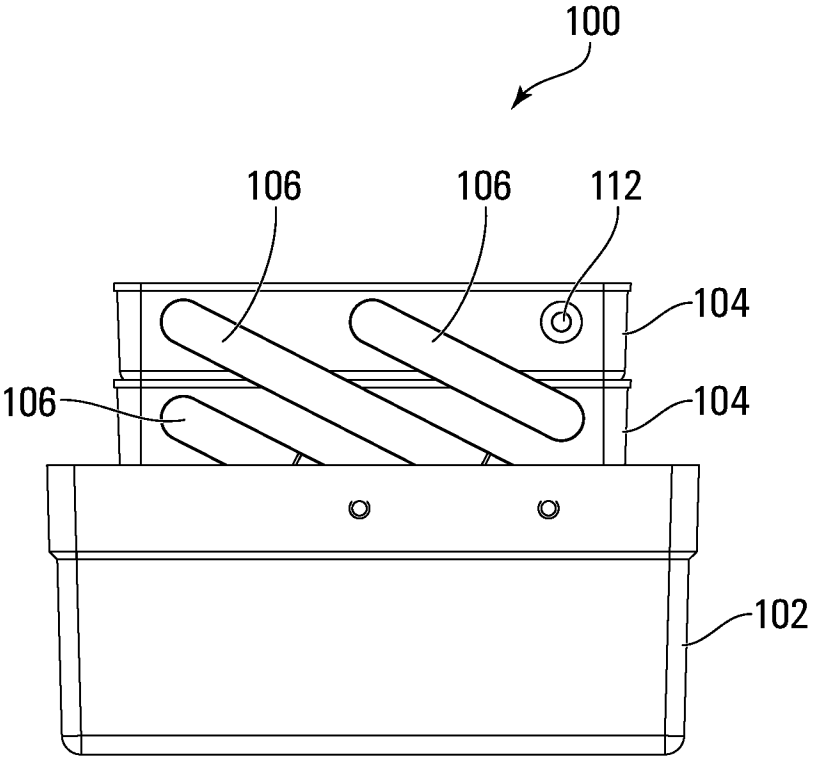
FIG. 2 is a front view of the vanity fold-out organizer of FIG. 1, in a closed position.
Figure 3:
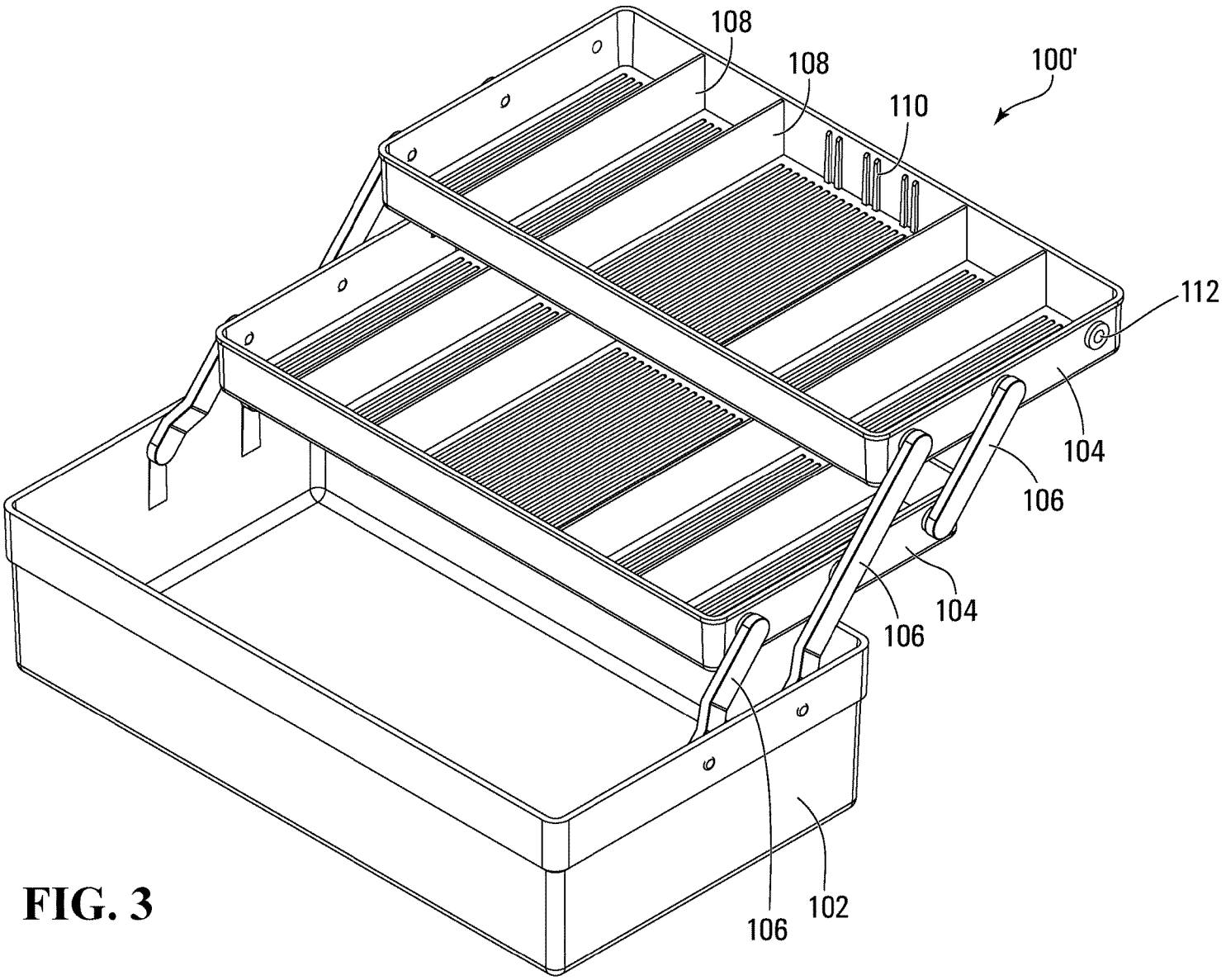
FIG. 3 is a perspective view of the vanity fold-out organizer of FIG. 1, in an open position.
Figure 5:
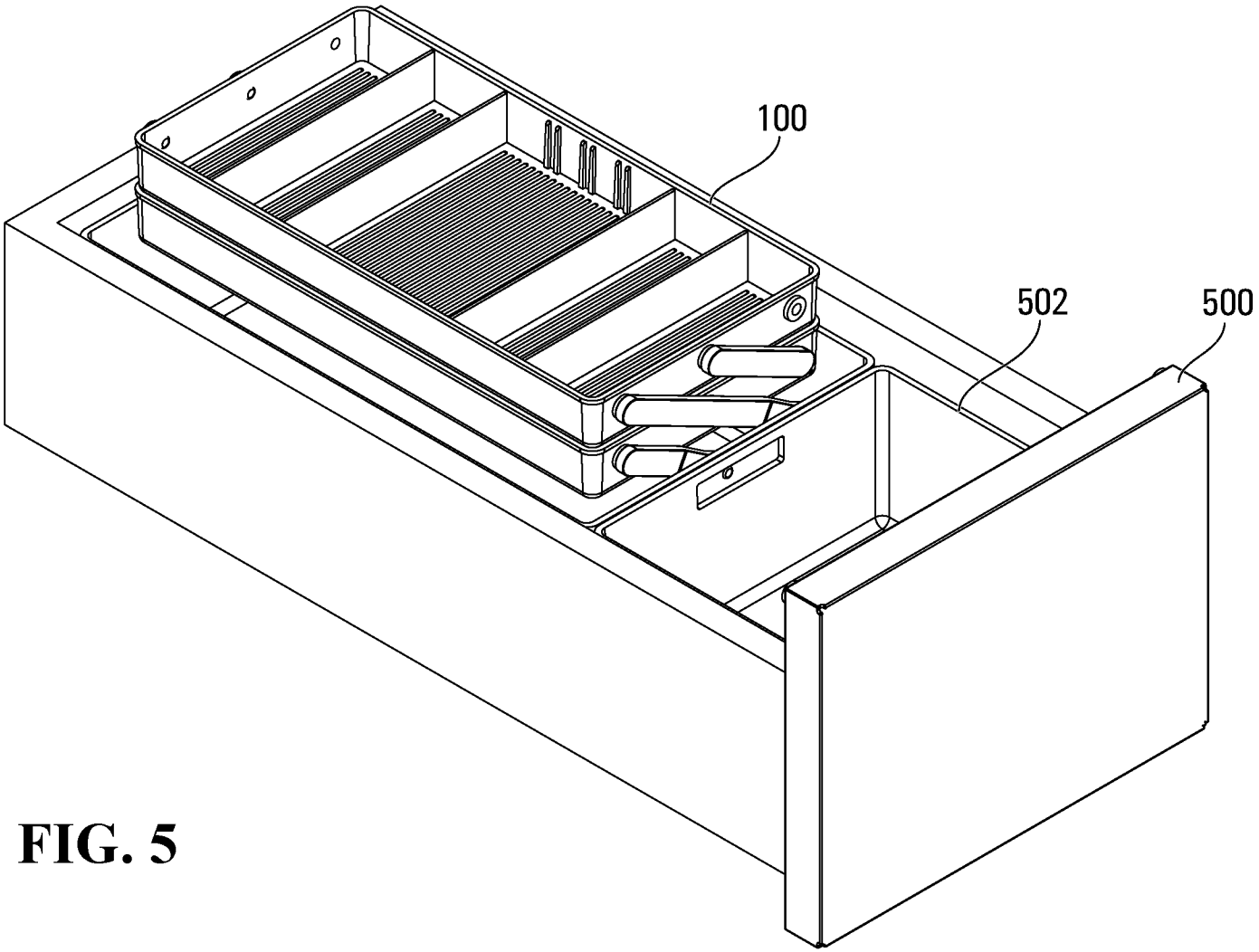
FIG. 5 is a perspective view of the vanity fold-out organizer of FIG. 1, inserted in a drawer of a vanity, in a closed position.
Figure 6:
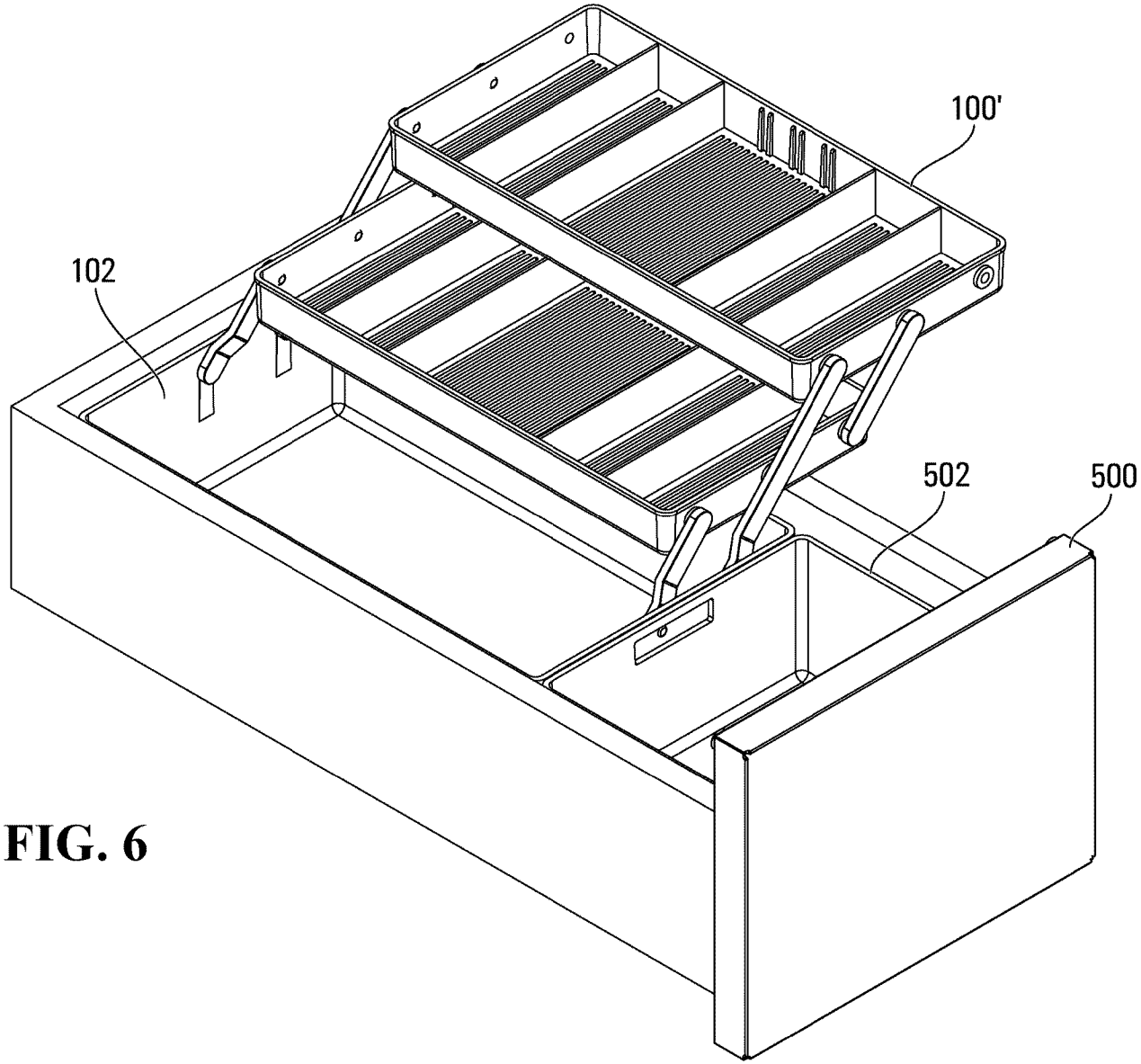
FIG. 6 is a perspective view of the vanity fold-out organizer of FIG. 1, inserted in a drawer of a vanity, in an open position.
Figure 7:
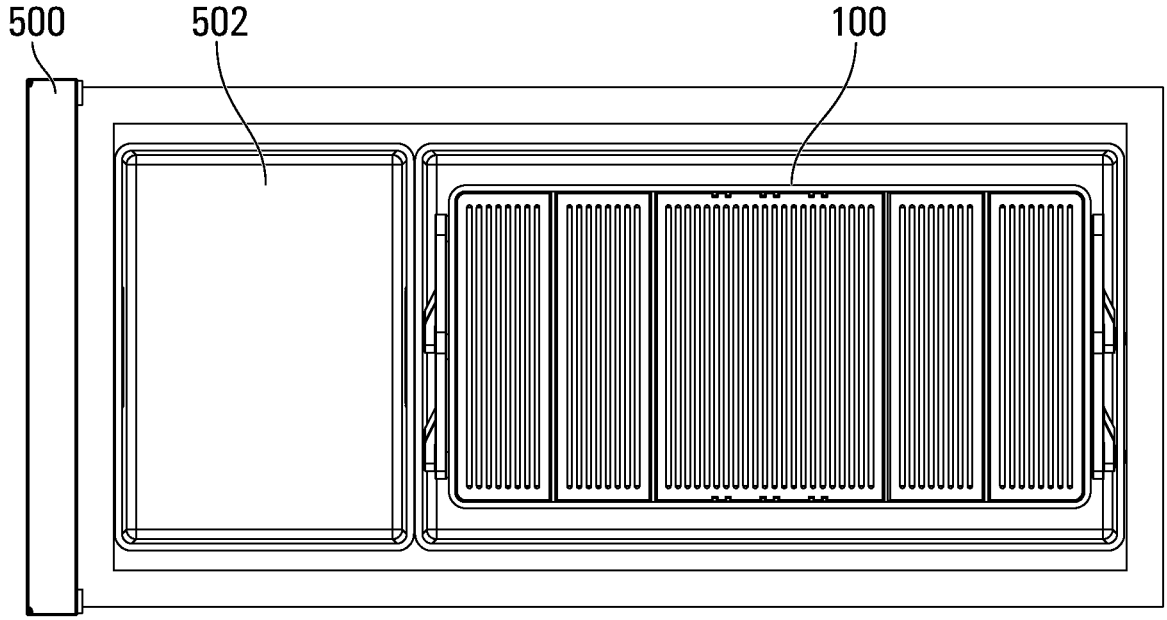
FIG. 7 is a top view of the vanity fold-out organizer of FIG. 5, inserted in a drawer of a vanity, in a closed position.
Figure 8:
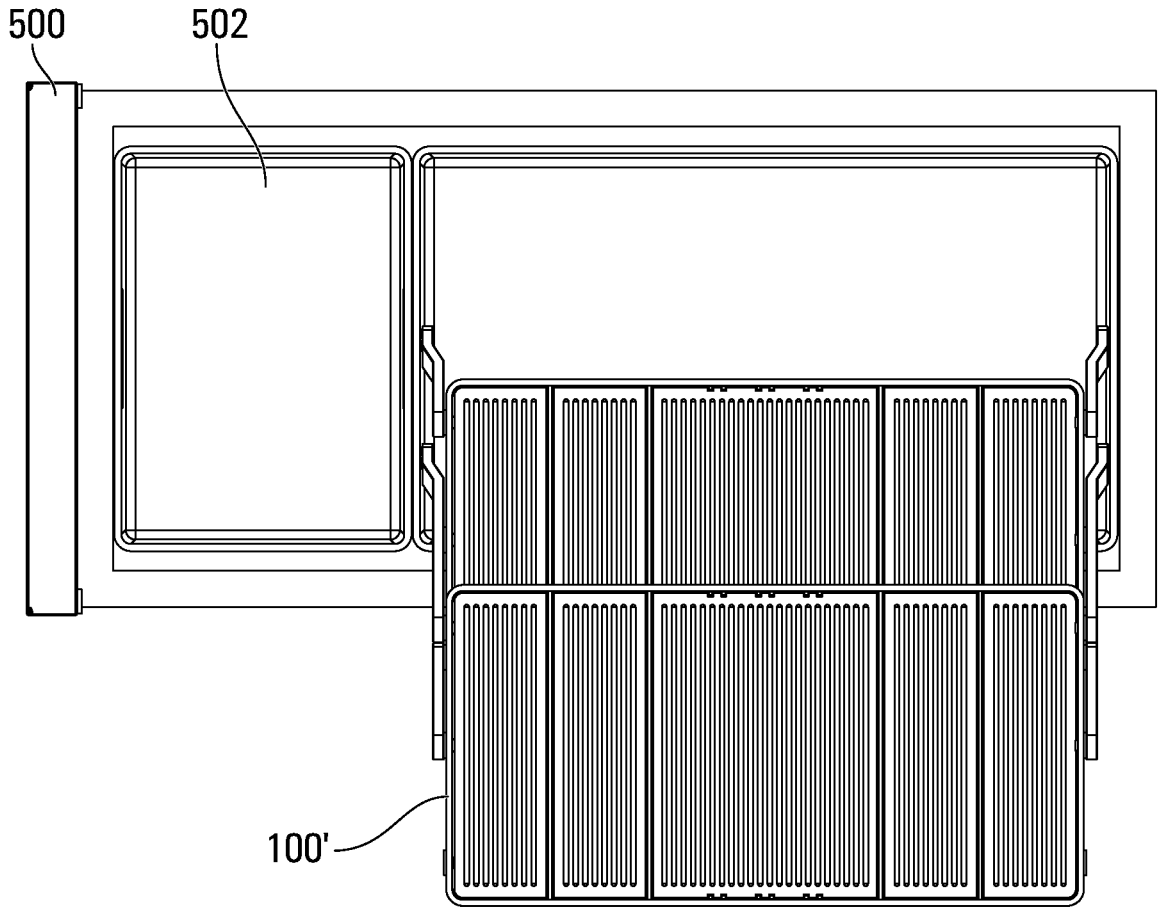
FIG. 8 is a top view of the vanity fold-out organizer of FIG. 6, inserted in a drawer of a vanity, in an open position.
Figure 9:
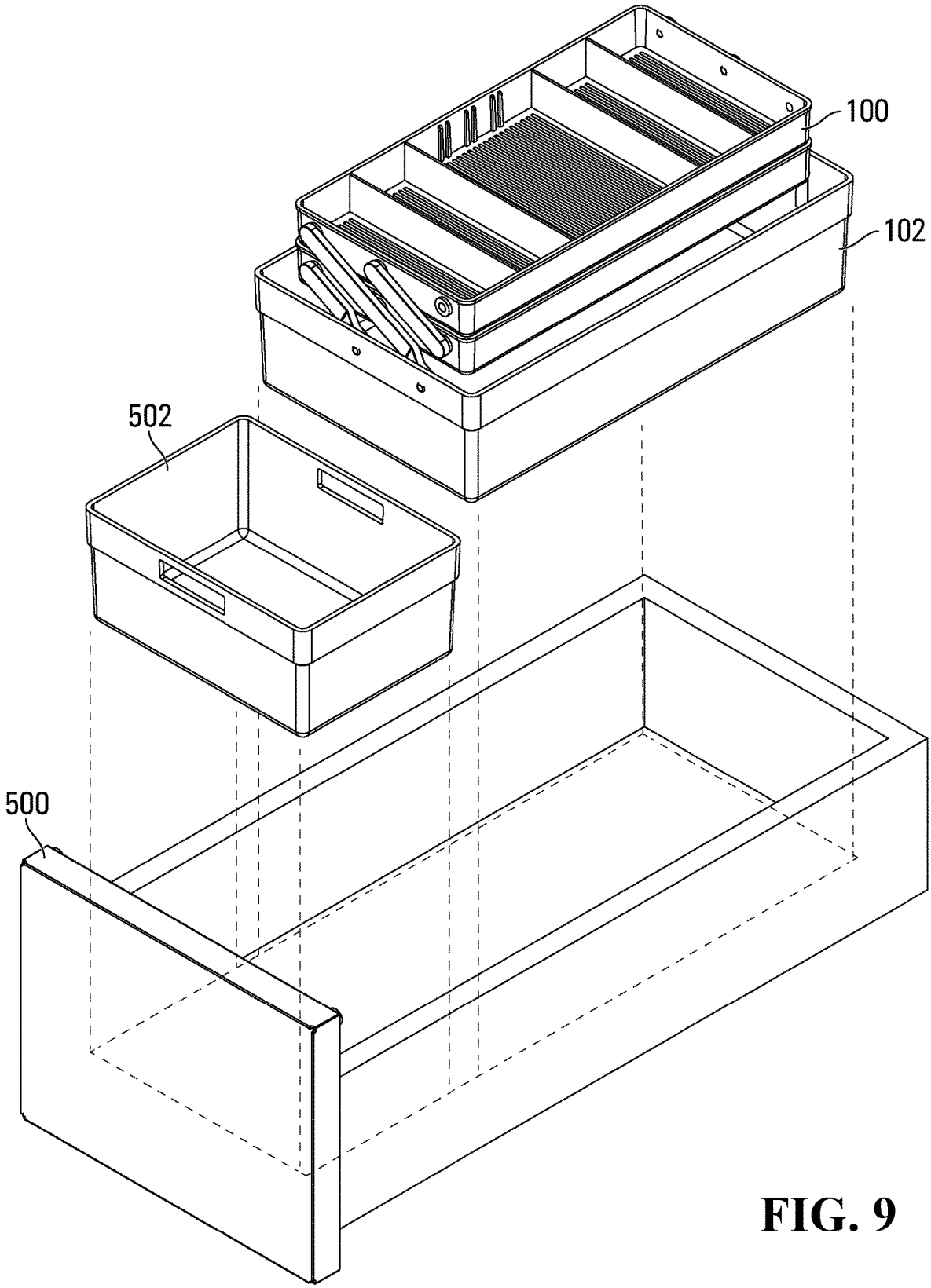
FIG. 9 is an extended perspective view of the vanity fold-out organizer of FIG. 1, for insertion in a drawer of a vanity.
Figure 10:
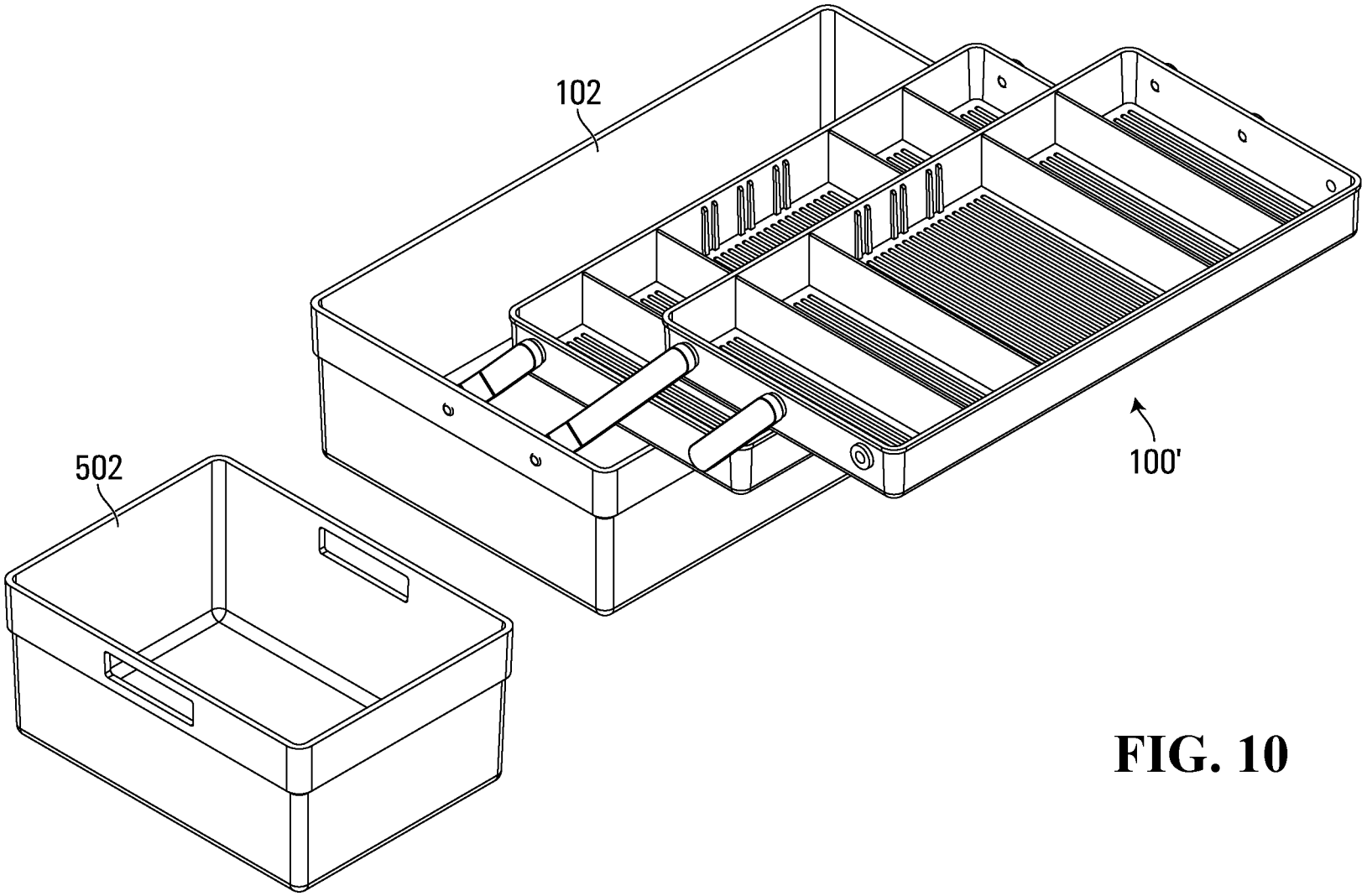
FIG. 10 is a perspective view of the vanity fold-out organizer of FIG. 1, in an open position, beside a bin organizer.
Figure 11:
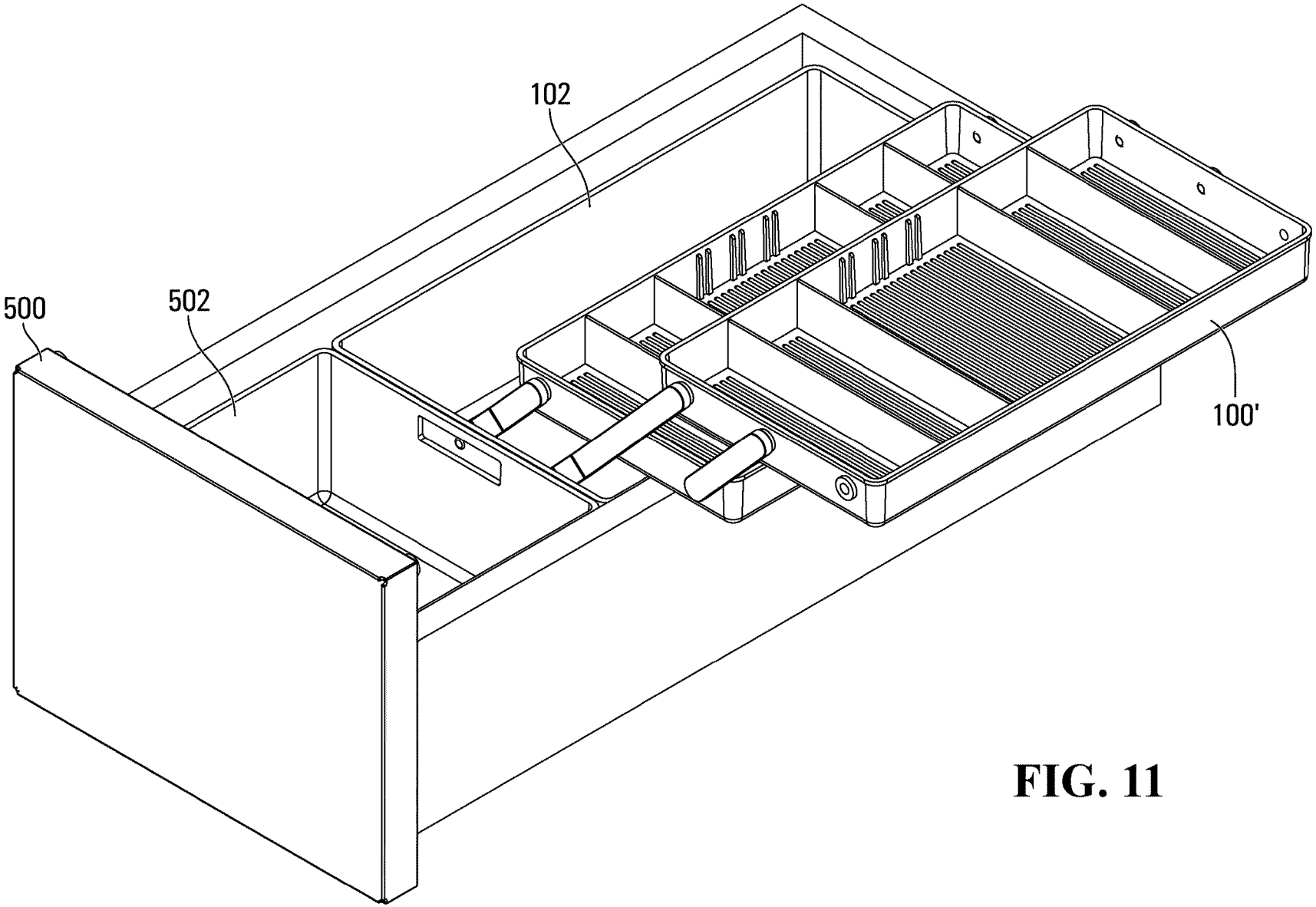
FIG. 11 is a perspective view of the vanity fold-out organizer of FIG. 1, inserted in a drawer of a vanity, in an open position.
Figure 13:
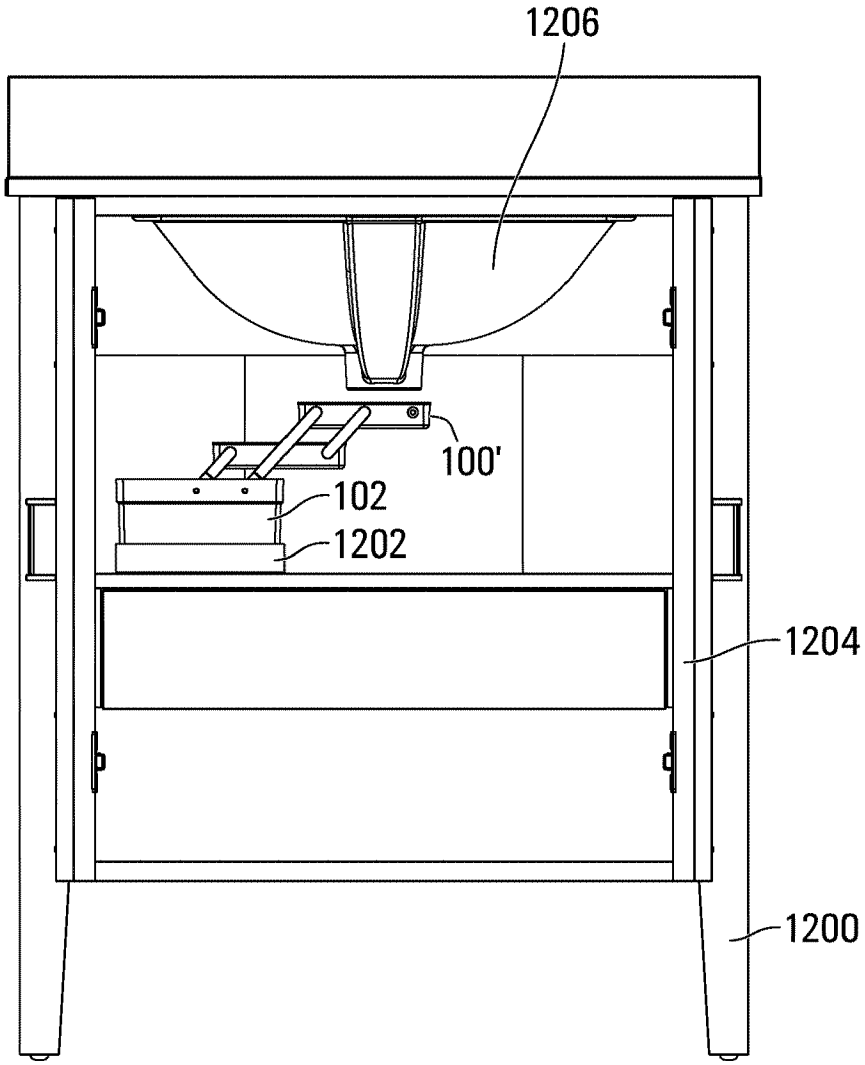
FIG. 13 is a front view of the vanity of FIG. 12 loaded with the vanity fold-out organizer of FIG. 1, in an open position.

With continued reference to FIG. 1, the vanity fold-out organizer 100 also includes trays 104 pivotably coupled to the body 102 by a plurality of links, hinges, pivots, or arms 106. As described and shown herein, the trays 104 can be pivotably moved relative to the body 102 between at least a closed (folded) position (FIG. 1) and an open (unfolded) position (FIG. 2). The organizer 100 can be sized, shaped, or otherwise configured to fit in a vanity drawer 500 (FIG. 5 and FIG. 9). In the example of FIG. 5, another storage box 502 is shown installed beside the vanity fold-out organizer 100.

Organizers of the present specification can be used with a wide range of other drawer configurations besides what is shown in the drawings, including drawers in different sizes and/or drawers mounted to different supporting structures at various locations (e.g., kitchens, closets, bathrooms, home offices, businesses, etc.) using any suitable mounting means (e.g., rails, brackets, etc.). Accordingly, the present specification should not be limited to the use of any specific form or type of drawer. As well, the present specification should not be limited to drawers either, as examples of the present specification can also be used with a wide range of other storage devices and storage spaces, including shelves, sliding shelves, open shelves, enclosed shelves, storage boxes, storage cabinets, and the like.

Figure 4:
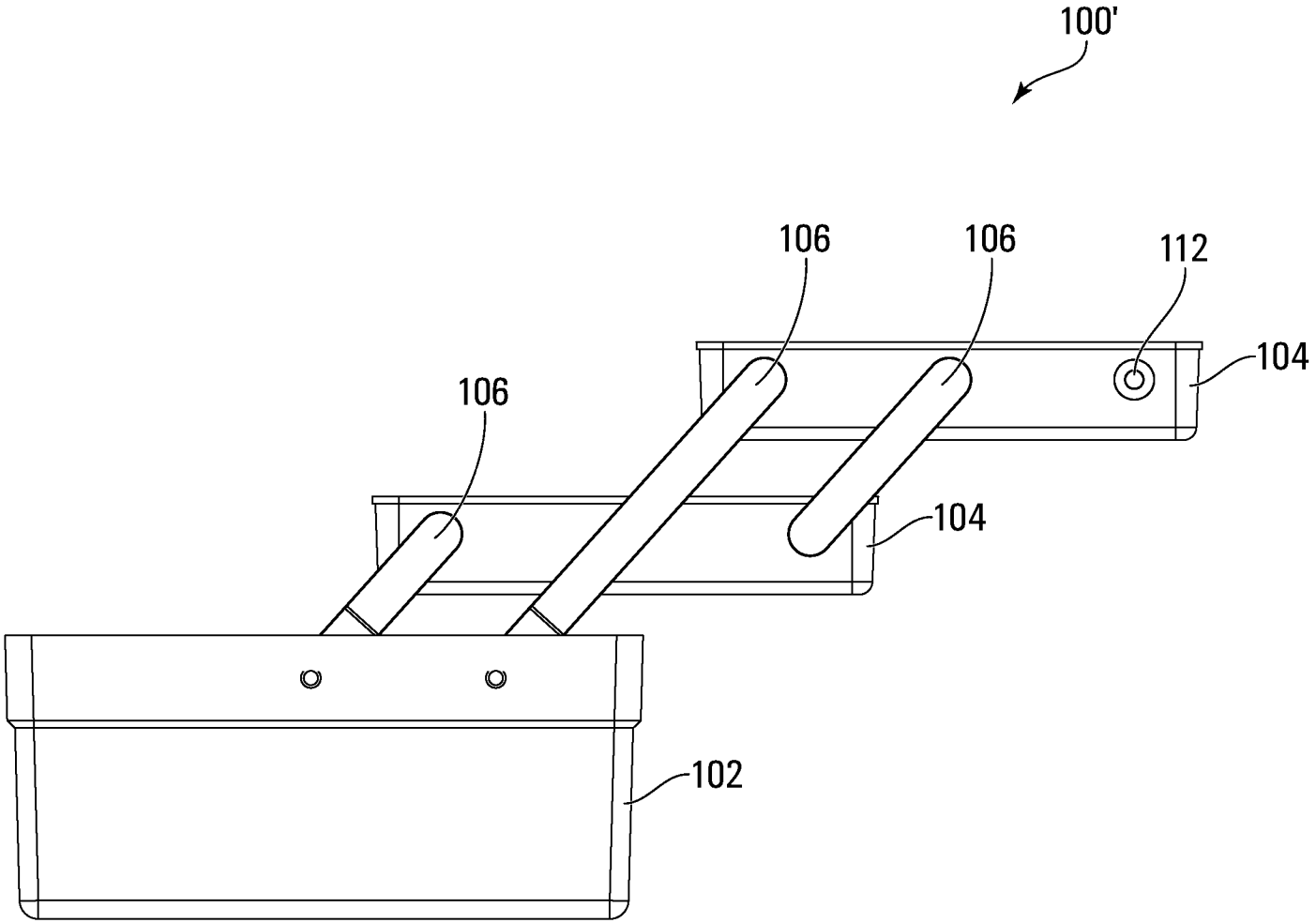
FIG. 4 is a front view of the vanity fold-out organizer of FIG. 1, in an open position.

According to some examples of the present specification, when in their closed positions, the trays 104 can be laterally disposed within the footprint of the body 102. When opened, however, the trays 104 can be, wholly or partially, disposed laterally outside the footprint of the body 102 (FIG. 4). The trays 104 can remain generally horizontal relative to the body 102 when the trays 104 are pivotably moved between their closed and open positions.

Two trays 104 are shown in the example of FIG. 1, but the skilled reader will appreciate that the organizer 100 can include more or fewer than two trays 104, can include one or more trays 104 having more or fewer walls and/or can include one or more trays having walls in different configurations (e.g., differently sized, spaced, oriented, arranged, etc.) besides what is shown in the drawings. According to these examples, one or more trays 104 can include more or fewer compartments and/or compartments in different configurations (e.g., differently sized, spaced, oriented, arranged, etc.) than what is shown in the drawings.

As shown in the example of FIG. 1, the organizer 100 has three links 106 at front and rear sides of the organizer 100. In this example, each link 106 has two ends. The first link 106 pivotably couples the body 102 at a first end to the lower tray 104 at a second end. The second link 106 pivotably couples the body 102 at a first end to the upper tray 104 at a second end. The third link 106 pivotably couples the lower tray 104 at a first end to the upper tray 104 at a second end. More or fewer links are encompassed within the present specification.

These pivotable connections allow the trays 104 to pivotably move relative to the body 102 between at least a closed position (FIGS. 1, 2, 5, 7, 9, 12, 14, 15, 17, 19) and an open position (FIGS. 3, 4, 6, 8, 10, 11, 13, 16, 18). The pivotable connections also allow the trays 104 to remain generally horizontal and/or parallel relative to the body 102 and/or other trays 104 as they are being moved between their closed and open positions. This helps keep items stored within the trays 104 to stay upright or otherwise in position as the trays 104 are moved relative to the body 102. The links can be removably or fixedly attached to a base and/or tray using any suitable means, including rivets, mechanical fasteners, snap joints, or the like. In one example, the axis of pivotable motion for the trays 104 is generally parallel with a slide plane of the drawer 500 (a side-to-side unfolding direction relative to the drawer). Other examples, however, can include one or more trays 104 having an axis of pivotable motion that is not parallel to the slide plane of the drawer 500. By way of example, a tray 104 that pivotably moves from a closed position to an open position in a generally back-to-front unfolding direction relative to the drawer. In such alternative embodiment, the tray's axis of pivotable motion is generally perpendicular to the slide plane of the drawer 500.

A comparison of FIG. 1 and FIG. 2 shows that the links 106 provide the trays 104 with a pivotable motion of about ninety degrees. Alternate examples can include one or more trays having a greater range or a lesser range of pivotable motion (e.g., more or less than ninety degrees, etc.) than that shown in the drawings.

In various examples, the trays may open automatically or with less force (e.g., spring-loaded, etc.) when the drawer is slidably opened and/or after a user releases one or more catches urging the trays in their closed positions. For example, biasing devices (e.g., coil springs, etc.) may be employed for causing the trays to pivot to their open position when the drawer is open and after the user releases catches associated with the trays. Other examples, however, include one or more trays that must be moved by the user without spring action.

Still with reference to FIG. 1, various examples also include one or more dividers or partitions 108 that can be used to increase the number of storage compartments or spaces associated with the organizer 100. Use of partitions 108 can improve organization of items stored within the drawer. The partitions 108 can be configured to define compartments or storage locations for a wide range of items therein. The partitions 108 can be removable partitions, fixedly attached partitions, integral partitions, or combinations thereof. When the partitions 108 are integral with a tray 104, the component may be monolithically formed. In other examples in which the dividers 108 are removable, the tray 104 may be provided with one or more notches 110 to receive the dividers 108. Alternative means of such as magnets, snaps, hook and loop fasteners, adhesives, mechanical fasteners, are intended to be included within the scope of the present specification.

Figure 12:
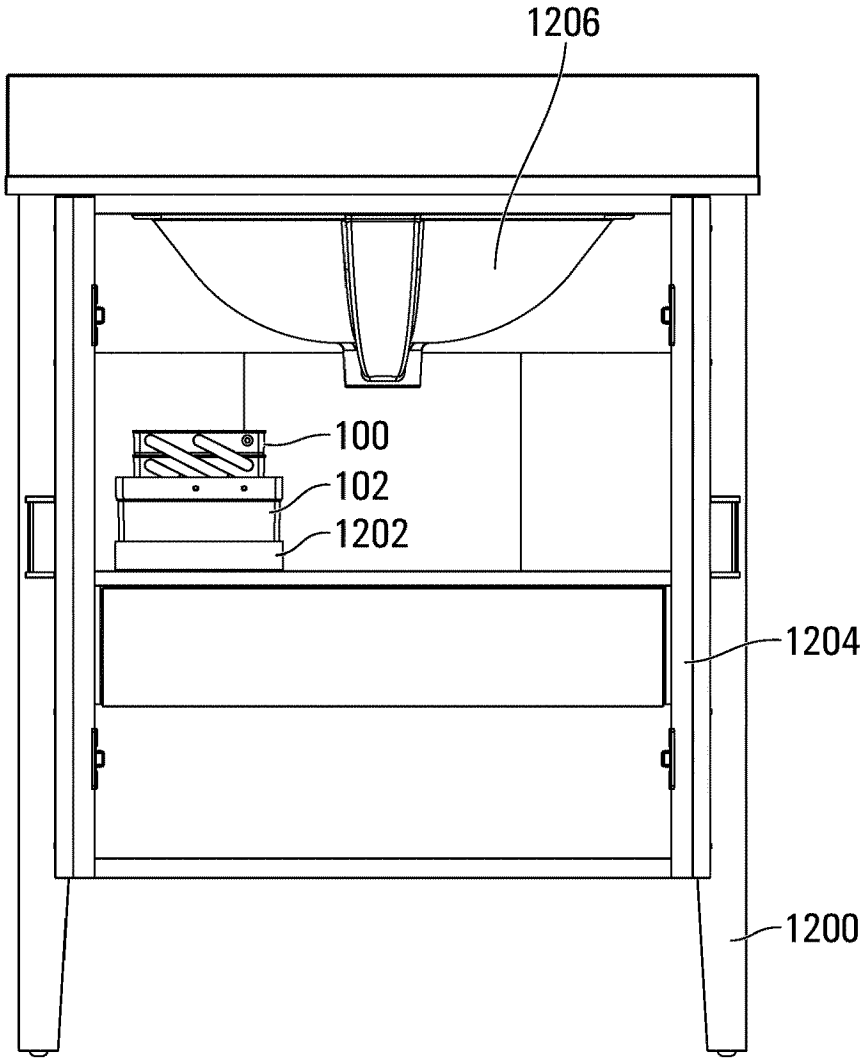
FIG. 12 is a front view of an exemplary vanity loaded with the vanity fold-out organizer of FIG. 1, in a closed position.
Figure 14:
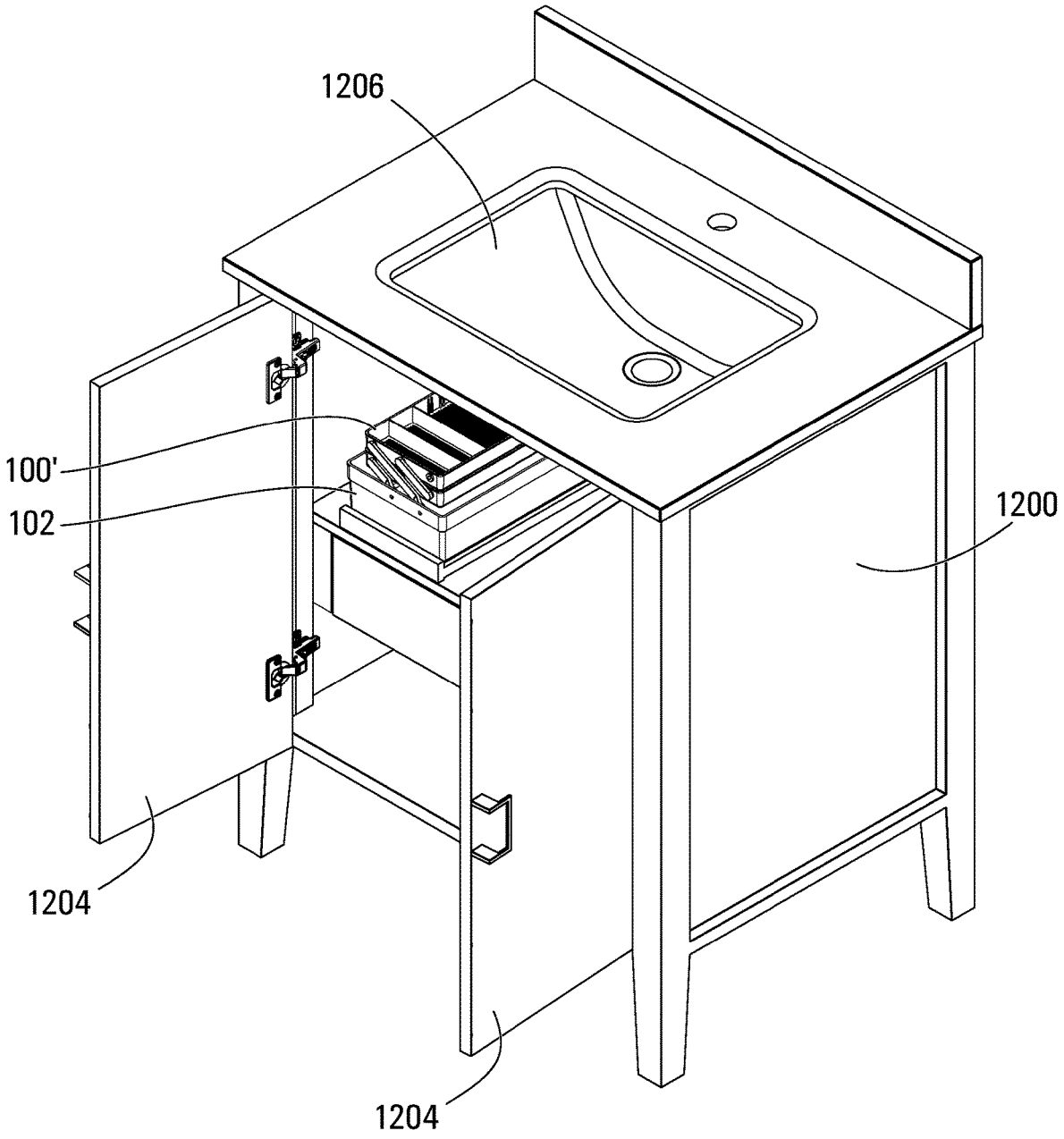
FIG. 14 is a perspective view of the vanity of FIG. 12 loaded with the vanity fold-out organizer of FIG. 1, in a closed and retracted position.
Figure 15:
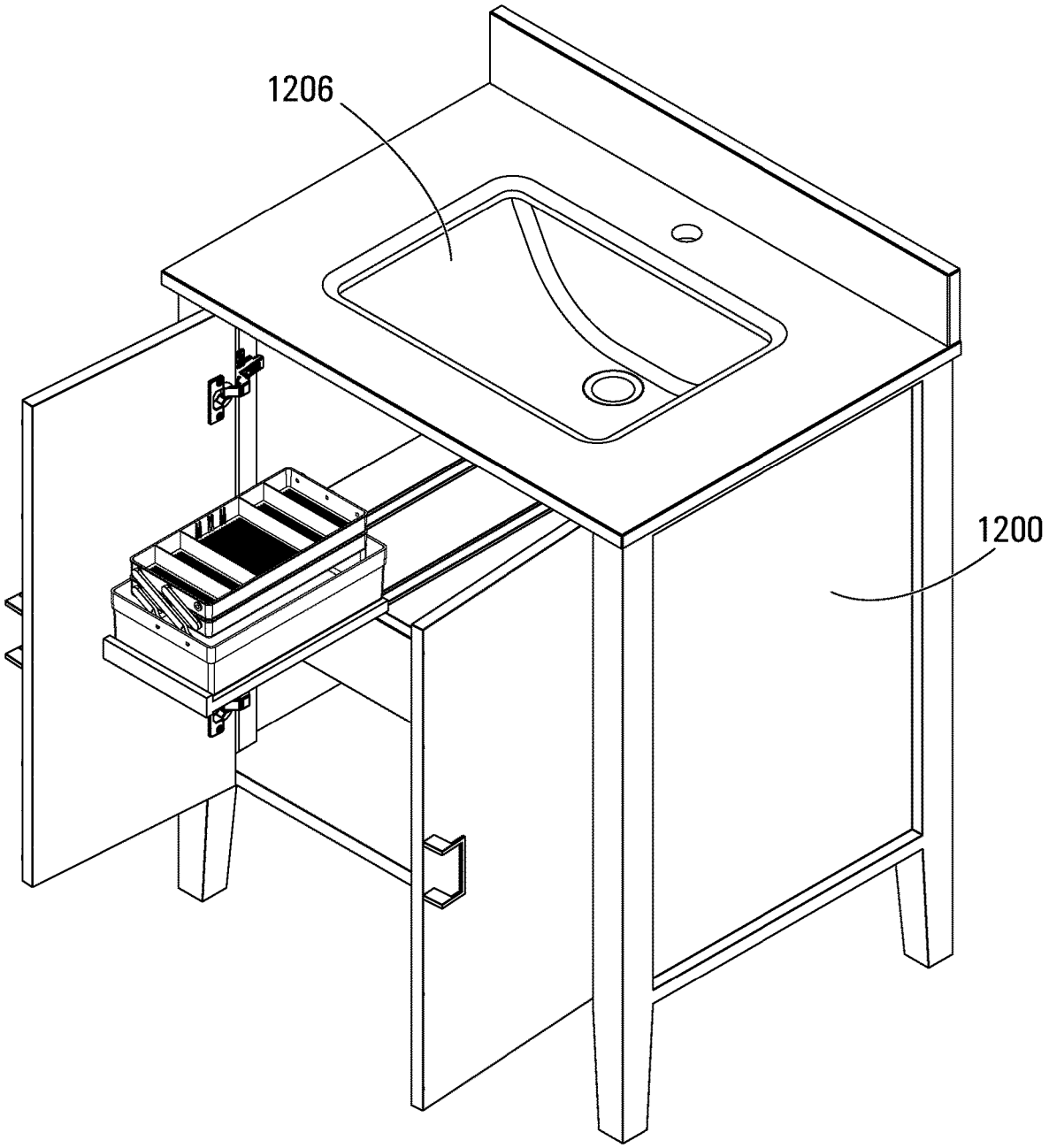
FIG. 15 is a perspective view of the vanity of FIG. 12 loaded with the vanity fold-out organizer of FIG. 1, in a closed and extended position.
Figure 16:
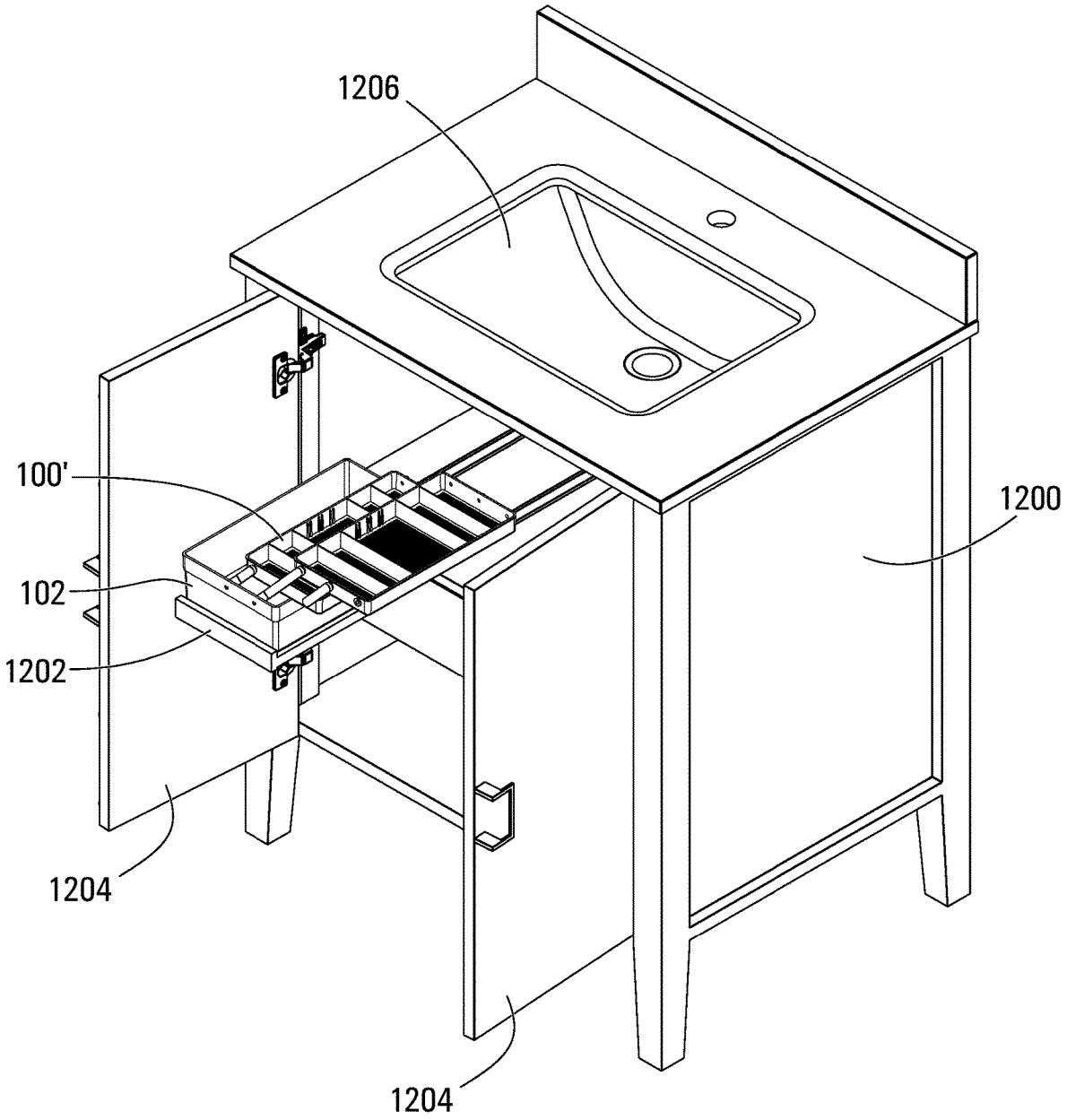
FIG. 16 is a perspective view of the vanity of FIG. 12 loaded with the vanity fold-out organizer of FIG. 1, in an open and extended position.
Figure 17:
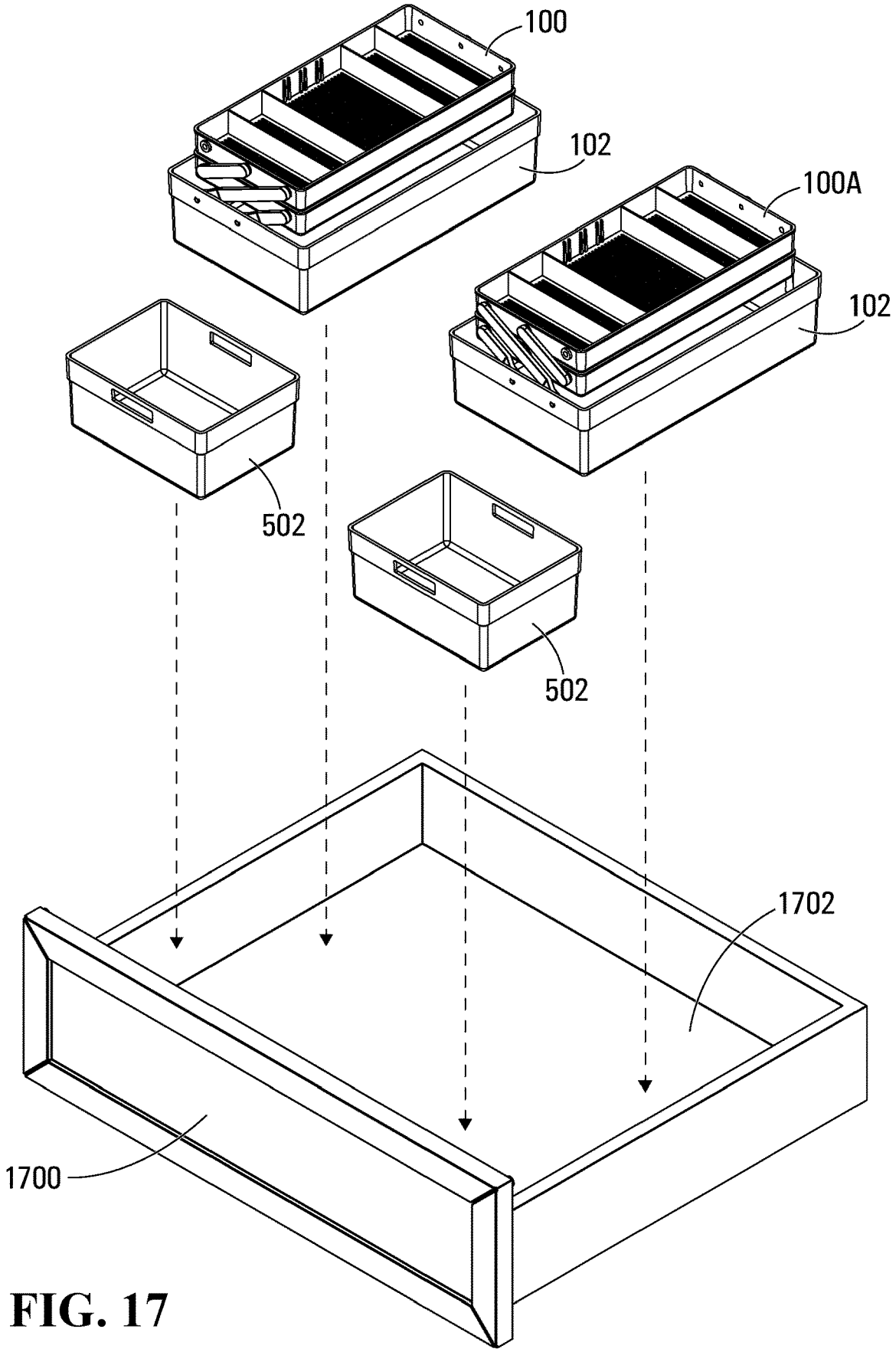
FIG. 17 is an extended perspective view of two vanity fold-out organizers of FIG. 1, for insertion in a drawer of a vanity.

Now with reference to FIG. 12, according to examples of the present specification, the organizer 100 is installed in a vanity 1200 having a basin 1206 and two doors 1204. The organizer is positioned on a shelf 1202 with sliding rails (not pictured). It will be appreciated that the interior of the vanity 1200 contains obstructions such as the sink, drainage system (or plumbing assembly) including a plumbing trap, hot and cold water supply lines, a shut-off valve, and faucet hardware, to name a few. Advantageously, the organizer 100 according to this example features a relatively low profile with trays positioned substantially beside the plumbing assembly, and thus taking advantage of the constrained space within the vanity interior to accommodate the plumbing assembly and provide space for useful and accessible storage when the trays are unfolded.

Figure 18:
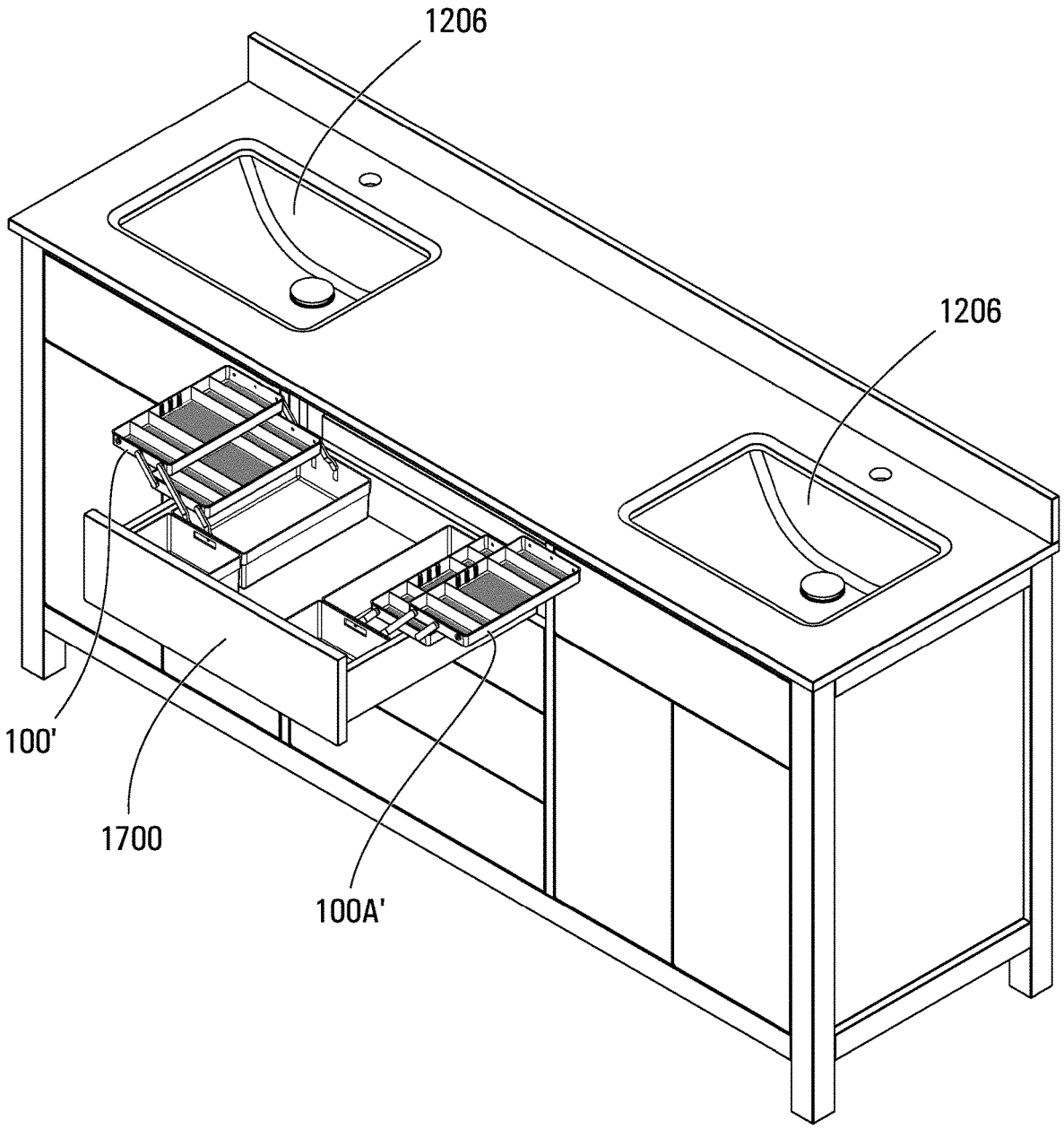
FIG. 18 is a perspective view of another exemplary vanity having a drawer loaded with two vanity fold-out organizers of FIG. 1, in opened and extended positions.
Figure 19:
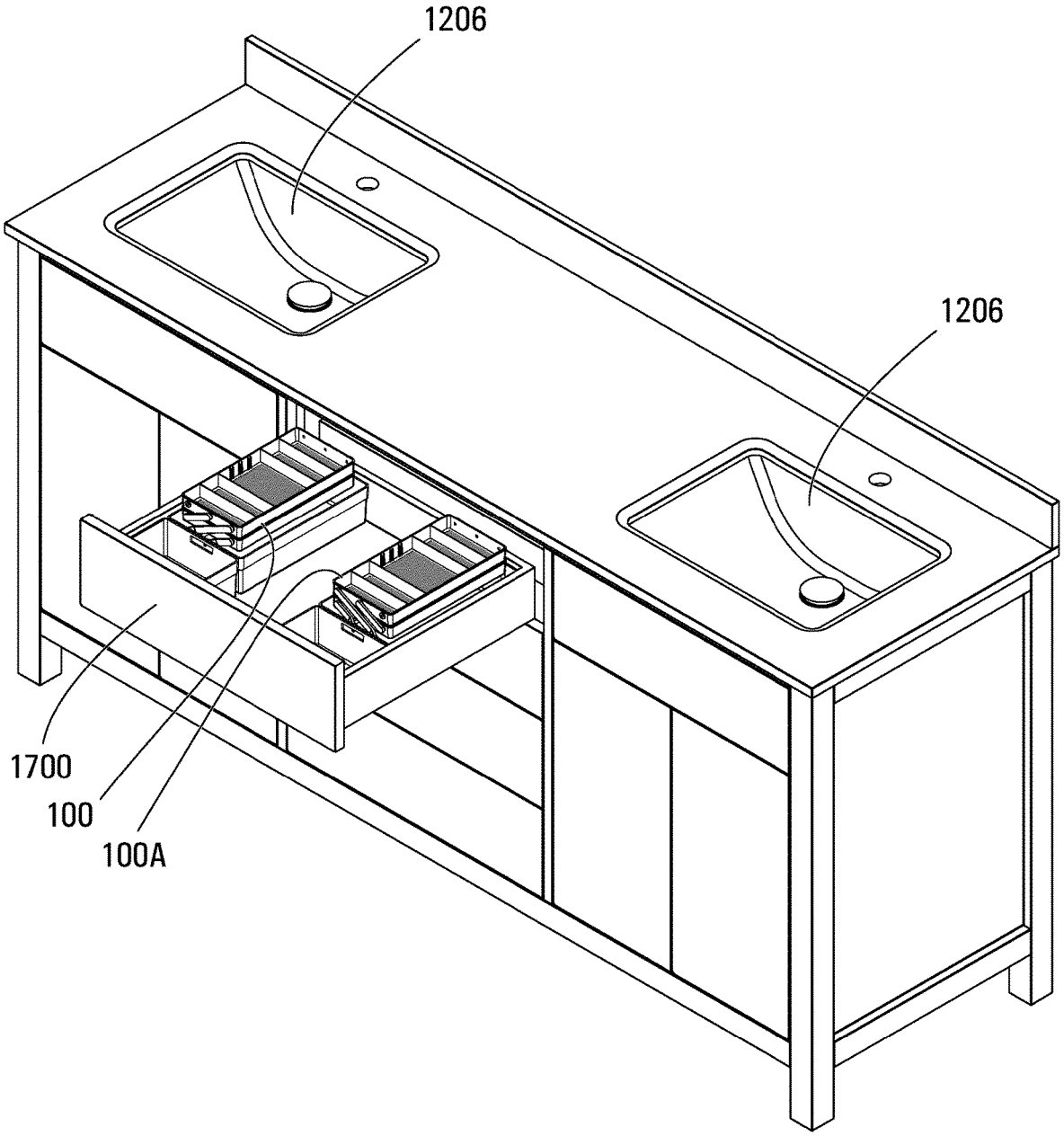
FIG. 19 is a perspective view of the vanity of FIG. 18 having the drawer loaded with two vanity fold-out organizers of FIG. 1, in closed and extended positions.

According to an alternative example shown at FIG. 18, a pair of organizers 100 are disposed within a drawer 1700 located beside two basins 1206 of a double vanity. FIG. 19 shows the closed position. Advantageously, the organizer 100 accommodates the basins of the double vanity and/or the plumbing assembly contained within the interior of the double vanity.

A wide range of materials may be used for the components of the various organizers of the present specification, and the same material need not be used for each component. In some embodiments, an organizer is fabricated using translucent or transparent plastic. The use of translucent or transparent or clear plastic permits the user to view the contents within the various compartments of the organizer more clearly.

A wide range of manufacturing processes can be employed for making the components of the various organizers and components of the present specification, and the same manufacturing process need not be used for each component. Exemplary manufacturing processes include cutting, injection molding, etc.

The present specification discloses an example of a vanity fold-out organizer that includes an organizer body and a first tray including a storage compartment positioned above the organizer body. A second tray is positioned above the first tray. A plurality of links couples the trays to the organizer body and/or lower trays to allow pivotable movement relative to the base between a tray open position and a tray closed position. The organizer body is disposed for sliding movement from a retracted position to an extended position relative to the vanity. The tray open position is available when the organizer body is in the extended position. The organizer body is configured to be disposed in a lower portion of the vanity partly beneath a plumbing assembly including a plumbing trap and the first and second trays are sized to fit beside the plumbing assembly in the tray closed position when the organizer body is in the retracted position. The sliding can be achieved by a sliding shelf and the organizer body is disposed on the sliding shelf.

According to some examples, the organizer body, the first tray and the second tray are shaped as rectangular boxes with open tops and are formed of plastic. The first tray and the second tray can include notches to accommodate dividers.

In one example, a pair of fold-out organizers for a vanity are arranged on either side of the plumbing assembly. The links of each pair are oriented to pivotably rotate away from opposing organizer bodies for pivotable movement to the tray open position.

The present specification also provides an exemplary vanity that includes a structural frame, a counter positioned on top of the structural frame, a basin disposed within the counter, a pair of hinged doors at a front of the structural frame providing access to an interior of the vanity, a shelf positioned within the interior of the vanity, and a sliding shelf disposed on the shelf. A fold-out organizer is disposed on the sliding shelf.

According to another example, a double vanity includes a structural frame, a counter positioned on top of the structural frame, two basins disposed within the counter, and at least one drawer at a front of the structural frame providing access to an interior of the vanity. A pair of fold-out organizers are disposed in the drawer. The pair are arranged on either side of the drawer and links of each pair are oriented to pivotably rotate away from opposing organizer bodies for pivotable movement to the tray open position.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements or components may be present, or utilized, or combined with other elements, components, or steps that are not expressly referenced.

What is claimed is:

1. A fold-out organizer for a vanity comprising:

an organizer body;

a first tray including a first storage compartment positioned above the organizer body;

a first link coupling the first tray to the organizer body such that the first tray is pivotably moveable relative to the organizer body between a tray open position and a tray closed position;

a second tray including a second storage compartment positioned above the first tray;

a second link coupling the second tray to the organizer body and a third link coupling the second tray to the first tray such that the second tray is pivotably moveable relative to the first tray and the organizer body between the tray open position and the tray closed position;

a support configured to permit sliding movement of the organizer body from a retracted position to an extended position relative to the vanity, wherein the tray open position is available when the organizer body is in the extended position;

the organizer body is disposed in a lower portion of the vanity partly beneath a plumbing assembly including a plumbing trap, and the first and second trays are sized to fit within the vanity on either side of the plumbing assembly in the tray closed position when the organizer body is in the retracted position;

and wherein the second storage compartment comprises an upwardly open top and is free of any overlying cover in the tray-closed position, such that a user can access items stored therein when the organizer body is retracted within the vanity and the trays are in the tray-closed position, and also when in the tray-open position.

2. The fold-out organizer of claim 1, wherein the organizer body is disposed on the support.

3. The fold-out organizer of claim 2 wherein the organizer body, the first tray and the second tray are shaped as rectangular boxes with open tops and are formed of plastic.

4. The fold-out organizer of claim 3 wherein the first tray and the second tray comprise notches to accommodate dividers.

5. The fold-out organizer of claim 1, wherein the fold-out organizer comprises a pair of organizer bodies arranged on either side of the plumbing assembly, and the first, second, and third links of each organizer body are oriented to pivotably rotate away from the opposing organizer body for pivotable movement to the tray open position.

6. A vanity comprising:

a structural frame;

a counter positioned on top of the structural frame;

a basin disposed within the counter;

a pair of hinged doors at a front of the structural frame providing access to an interior of the vanity;

a shelf positioned within the interior of the vanity;

a support disposed on the shelf;

a fold-out organizer disposed on the support comprising:

an organizer body;

a first tray including a first storage compartment positioned above the organizer body;

a first link coupling the first tray to the organizer body such that the first tray is pivotably moveable relative to the organizer body between a tray open position and a tray closed position;

a second tray including a second storage compartment positioned above the first tray;

a second link coupling the second tray to the organizer body and a third link coupling the second tray to the first tray such that the second tray is pivotably moveable relative to the first tray and the organizer body between the tray open position and the tray closed position;

the support for moving the organizer body from a retracted position to an extended position relative to the vanity, wherein the tray open position is available when the organizer body is in the extended position;

the organizer body is disposed in a lower portion of the vanity partly beneath a plumbing assembly including a plumbing trap, and the first and second trays are sized to fit within the vanity on either side of the plumbing assembly in the tray closed position when the organizer body is in the retracted position;

and wherein the second storage compartment comprises an upwardly open top and is free of any overlying cover in the tray-closed position, such that a user can access items stored therein when the organizer body is retracted within the vanity and the trays are in the tray-closed position, and also when in the tray-open position.

7. A double vanity comprising:

a structural frame;

a counter positioned on top of the structural frame;

two basins disposed within the counter;

at least one drawer at a front of the structural frame providing access to an interior of the vanity;

a pair of fold-out organizers disposed in the drawer, each comprising:

an organizer body;

a first tray including a first storage compartment positioned above the organizer body;

a first link coupling the first tray to the organizer body such that the first tray is pivotably moveable relative to the organizer body between a tray open position and a tray closed position;

a second tray including a second storage compartment positioned above the first tray;

a second link coupling the second tray to the organizer body and a third link coupling the second tray to the first tray such that the second tray is pivotably moveable relative to the first tray and the organizer body between the tray open position and the tray closed position;

the drawer configured to permit sliding movement of the organizer body from a retracted position to an extended position relative to the vanity, wherein the tray open position is available when the organizer body is in the extended position;

the pair are arranged on either side of the drawer and the first, second, and third links of each organizer body are oriented to pivotably rotate away from the opposing organizer body for pivotable movement to the tray open position;

and wherein the second storage compartment comprises an upwardly open top and is free of any overlying cover in the tray-closed position, such that a user can access items stored therein when the organizer body is retracted within the vanity and the trays are in the tray-closed position, and also when in the tray-open position.

* * * * *